US006405403B1

(12) United States Patent
McKay

(10) Patent No.: US 6,405,403 B1
(45) **Date of Patent: *Jun. 18, 2002**

(54) CLEANING TOOL WITH REMOVABLE CLEANING SHEETS

(76) Inventor: William D. McKay, G-9082 S. Saginaw, Grand Blanc, MI (US) 48439

( * ) Notice: Subject to any disclaimer, the term of this patent is extended or adjusted under 35 U.S.C. 154(b) by 0 days.

This patent is subject to a terminal disclaimer.

(21) Appl. No.: 09/602,189

(22) Filed: Jun. 12, 2000

Related U.S. Application Data

(63) Continuation-in-part of application No. 09/094,551, filed on Jun. 12, 1998, now Pat. No. 6,298,517.

(51) Int. Cl.[7] ..... A47L 13/20; A47L 13/24
(52) U.S. Cl. ..... 15/228; 15/144.1; 15/231
(58) Field of Search ..... 15/104.94, 227, 15/104.002, 231, 232

(56) References Cited

U.S. PATENT DOCUMENTS

| | | | | | |
|---|---|---|---|---|---|
| 466,337 | A | | 1/1892 | Fries | 15/231 |
| 1,587,670 | A | | 6/1926 | Nebelung | 15/231 |
| 1,852,114 | A | | 4/1932 | Green | 15/104.93 |
| 2,301,505 | A | | 11/1942 | Bates | 15/231 |
| 2,414,872 | A | | 1/1947 | Harter | 15/231 |
| 2,465,194 | A | | 3/1949 | Brouty | 15/231 |
| 2,648,863 | A | | 8/1953 | Darling | 15/231 |
| 2,693,610 | A | * | 11/1954 | Hensley, Jr. | 15/104.002 |
| 2,702,913 | A | | 3/1955 | Walkama | 15/104.002 |
| 2,708,761 | A | | 5/1955 | Bergquist | 15/104.002 |
| 2,715,742 | A | * | 8/1955 | Coles | 15/104.002 |
| 2,724,847 | A | * | 11/1955 | Krasno | 15/104.002 |
| 2,739,334 | A | | 3/1956 | Hardey | 15/231 |
| 2,756,549 | A | | 7/1956 | Macullar | 451/491 |
| 2,870,475 | A | | 1/1959 | Scheuer et al. | 15/231 |
| 3,056,154 | A | * | 10/1962 | Neal | 15/104.002 |
| 3,083,393 | A | * | 4/1963 | Nappi | 15/104.002 |
| RE25,435 | E | * | 8/1963 | Norman | 15/104.002 |
| 3,199,136 | A | | 8/1965 | George | 15/231 |
| 3,273,192 | A | | 9/1966 | Mazzella | 15/144.1 |
| 3,329,985 | A | * | 7/1967 | Glowacki, Jr. | 15/104.001 |
| 3,373,457 | A | * | 3/1968 | Rouch, Jr. | 15/104.002 |
| 3,376,595 | A | | 4/1968 | Cole | 15/228 |
| 3,506,996 | A | | 4/1970 | Brennan | 15/144.1 |
| 3,613,146 | A | | 10/1971 | Oviatt | 15/231 |
| 3,742,547 | A | | 7/1973 | Sohmer | 15/104.002 |
| 4,114,223 | A | | 9/1978 | Buchanan | 15/228 |
| 4,143,194 | A | * | 3/1979 | Wihksne | 15/104.002 |
| 4,427,726 | A | * | 1/1984 | Wolfrum | 15/104.002 |
| 4,510,640 | A | * | 4/1985 | Omori | 15/105 |
| 4,712,268 | A | * | 12/1987 | Heinonen | 15/231 |
| 4,817,229 | A | | 4/1989 | Sedillo | 15/144.1 |
| 4,820,558 | A | * | 4/1989 | Sundberg | 15/104.002 |
| 4,937,910 | A | | 7/1990 | Frazier | 15/231 |
| 4,991,250 | A | | 2/1991 | Young | 15/228 |
| 5,012,542 | A | | 5/1991 | Lynn | 15/1 |

(List continued on next page.)

FOREIGN PATENT DOCUMENTS

| | | | | |
|---|---|---|---|---|
| CA | 752591 | * | 2/1967 | 15/227 |
| GB | 2233882 | | 1/1991 | 15/104.002 |

*Primary Examiner*—Robert J. Warden, Sr.
*Assistant Examiner*—Theresa T. Snider
(74) *Attorney, Agent, or Firm*—Gifford, Krass, Groh, Sprinkle, Anderson & Citkowski, P.C.

(57) ABSTRACT

A cleaning tool for cleaning a surface has a core with a lower surface and an upper surface. A first set of cleaning sheets is each removably supported on the lower surface in a stacked configuration. Each of the sheets includes a bibulous layer and a moisture barrier layer. The moisture barrier layer prevents transport of liquid from one bibulous layer of one sheet to the bibulous layer of an adjacent sheet. Each of the sheets has an outward face for cleaning and an opposed inward face. The outward face of the sheets is designed to contact and clean a surface and thereby become soiled. Once the outward face of the outermost sheet becomes soiled, the sheet may be peeled away to expose a non-soiled sheet.

22 Claims, 5 Drawing Sheets

U.S. PATENT DOCUMENTS

| | | | | | |
|---|---|---|---|---|---|
| 5,071,489 | A | | 12/1991 | Silvenis et al. | 15/231 |
| 5,094,559 | A | | 3/1992 | Rivera et al. | 401/132 |
| 5,280,661 | A | * | 1/1994 | Brown | 15/214 |
| 5,435,852 | A | | 7/1995 | Robinson | 134/6 |
| 5,455,980 | A | | 10/1995 | Buchanan | 15/228 |
| 5,477,582 | A | | 12/1995 | Yamashita | 15/231 |
| 5,522,648 | A | | 6/1996 | Wilen | 300/21 |
| 5,525,397 | A | | 6/1996 | Shizuno et al. | 428/138 |
| 5,553,344 | A | | 9/1996 | Rosenkrantz | 15/104.002 |
| 5,596,787 | A | | 1/1997 | Stevens et al. | 15/228 |
| 5,603,138 | A | | 2/1997 | Bonis | 15/220.1 |
| 5,639,532 | A | | 6/1997 | Wells | 428/95 |
| 5,694,659 | A | * | 12/1997 | Merrion | 15/104.001 |
| 5,763,038 | A | * | 6/1998 | Wood | 15/104.002 |
| 5,878,459 | A | | 3/1999 | McParland | 15/144.1 |
| 5,894,623 | A | * | 4/1999 | Thill | 15/104.002 |
| 5,924,157 | A | * | 7/1999 | Barela | 15/104.002 |
| 6,024,970 | A | * | 2/2000 | Woodard | 15/227 |
| 6,298,517 | B1 | * | 10/2001 | McKay | 15/144.1 |

* cited by examiner

FIG - 1
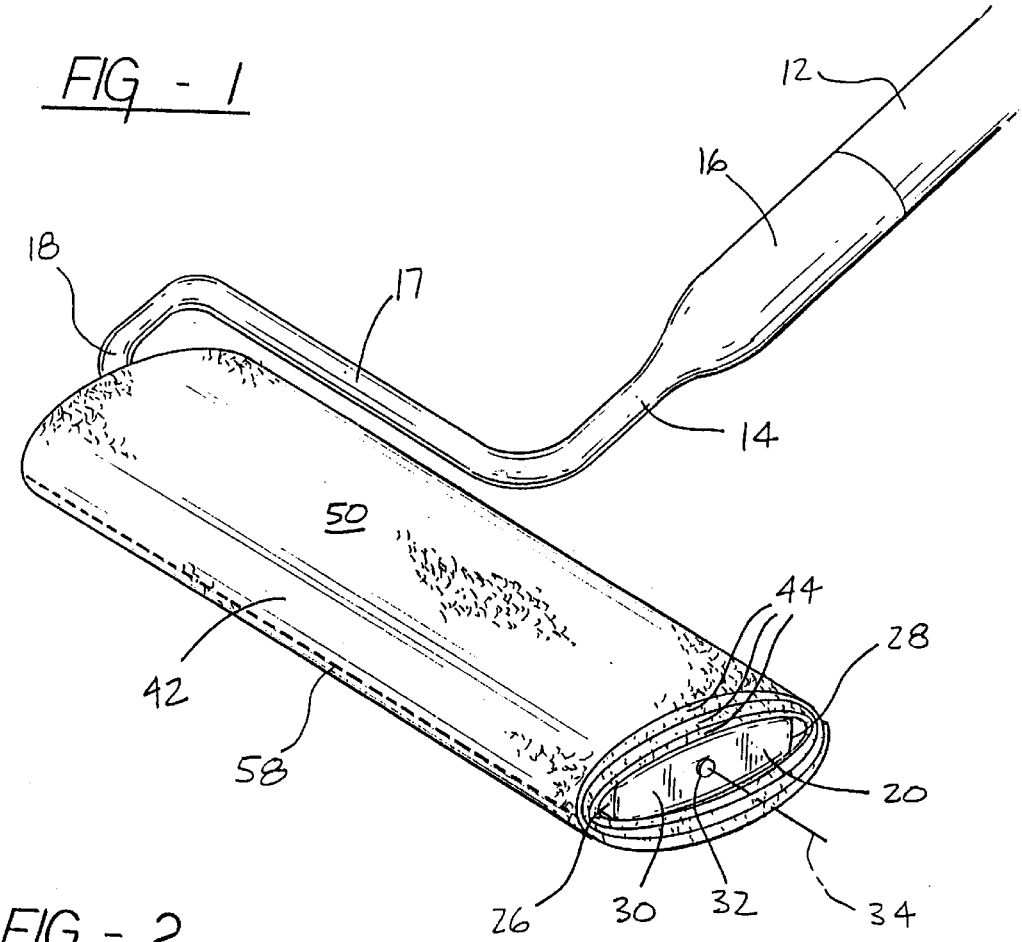
FIG - 2
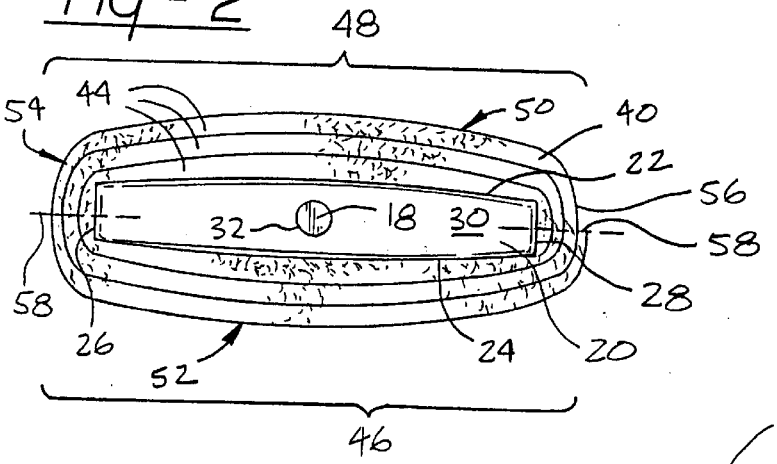
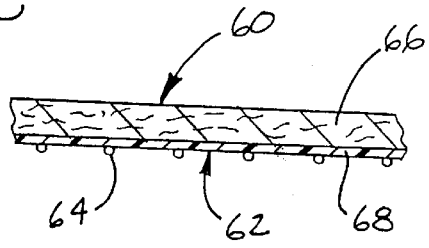
FIG - 3

FIG-7
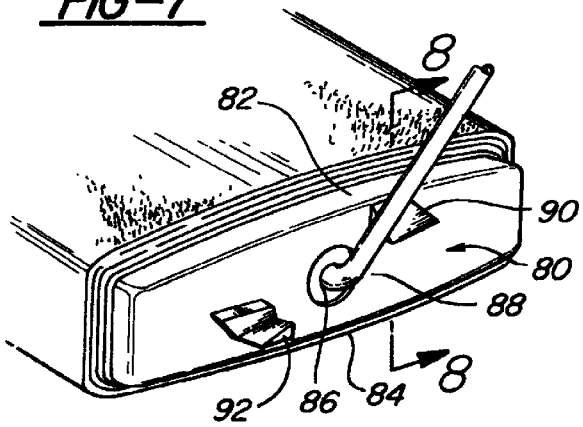
FIG-8
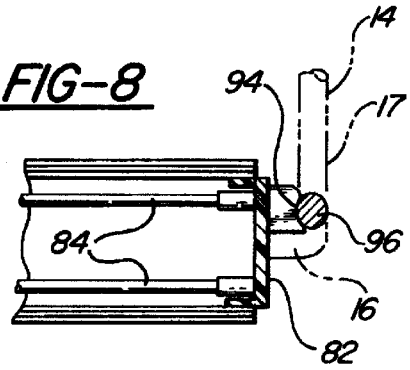
FIG-9
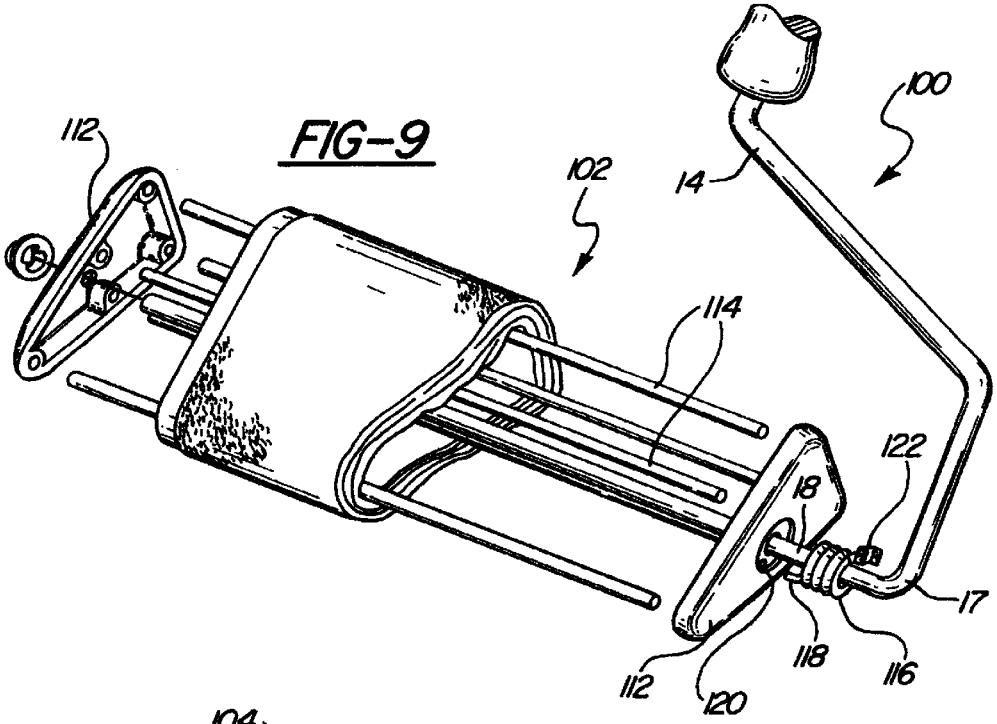
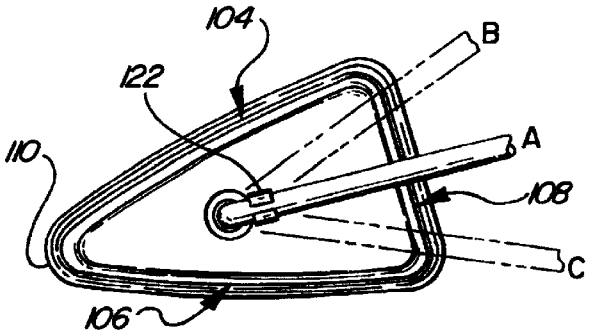
FIG-10

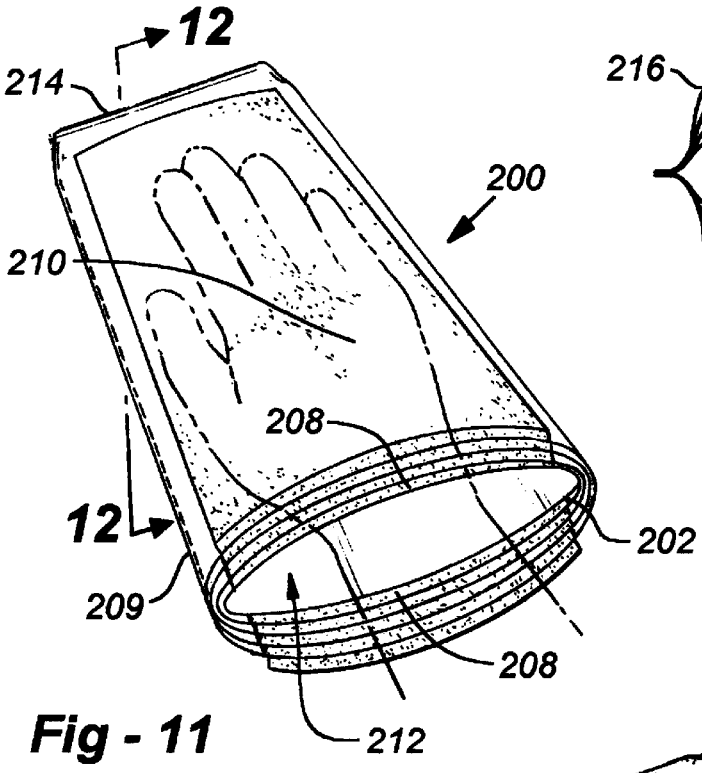
Fig - 11
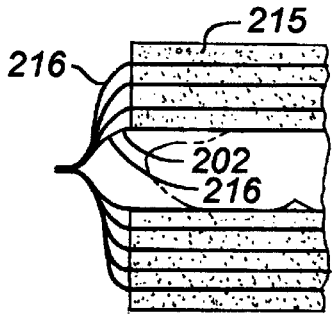
Fig - 12
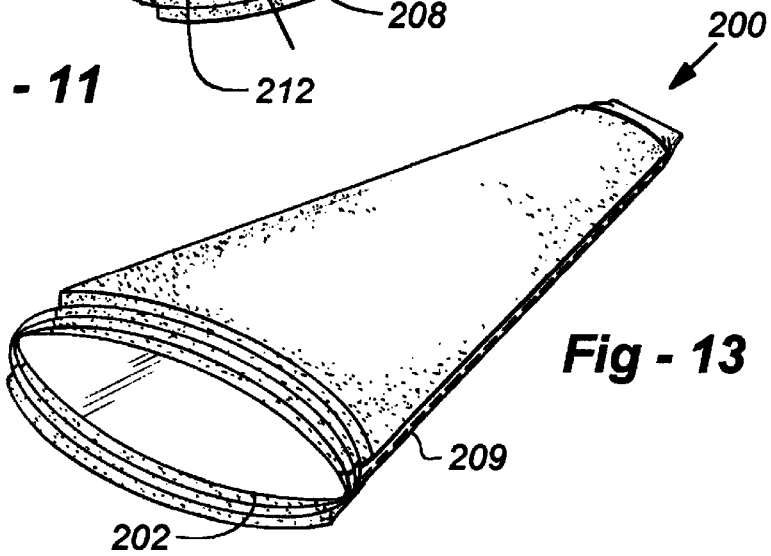
Fig - 13
Fig - 14
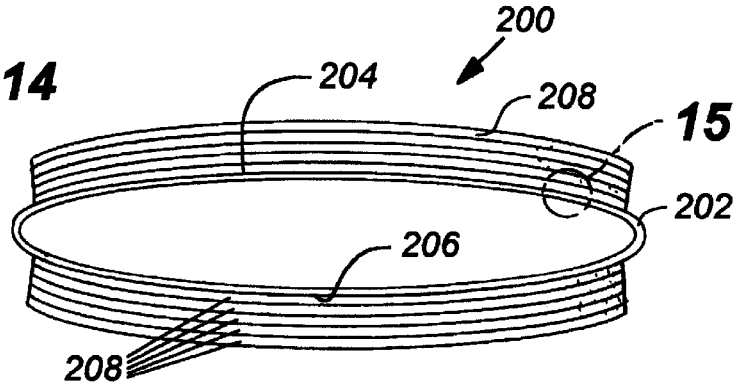

CLEANING TOOL WITH REMOVABLE CLEANING SHEETS

RELATED APPLICATION

This patent application is a Continuation-in-Part of copending patent application Ser. No. 09/094,551 filed Jun. 12, 1998 entitled "Cleaning Tool With Removable Cleaning Sheets now U.S. Pat. No. 6,298,517."

FIELD OF THE INVENTION

This invention relates generally to tools for cleaning surfaces such as counters, mirrors, windows, floors, walls, ceilings, pet coats, and furniture surfaces and, more specifically, to a cleaning tool having removable cleaning sheets.

BACKGROUND OF THE INVENTION

Surfaces such as counters and floors are most aesthetically pleasing and safe when they are clean, dry, and free of dirt or debris. Unfortunately, surfaces typically become soiled rapidly due to environmental contaminants such as dust and due to the deposit of dirt and debris and liquids by people, machines, and pets. Numerous devices and methods have been developed for returning a surface to a clean and dry condition and people are constantly striving to develop better methods. Sweeping or vacuuming works well for removing loose dirt and debris, and mopping works well for removing liquids and certain debris which is lightly adhered to a surface such as a tile or wood floor. Serious stains and sticky dirt and debris may require scrubbing and the use of strong chemicals. These methods work well to thoroughly clean a surface such as a floor but all suffer from the drawback of being time consuming and difficult. In addition, it is often not necessary to thoroughly clean the surface to return it to a clean and dry condition. For example, a small spill or localized deposit of dirt and debris does not necessitate a vacuuming or mopping of the entire floor. However, they still require the use of the same equipment. For example, to vacuum even a small area requires a person to locate the vacuum cleaner, uncoil and plug in a power cord, select the correct attachments, vacuum up the dirt and debris, and reverse the process to put the vacuum cleaner back away. Likewise, mopping even in a small area requires the use of a mop and bucket. Either approach is time consuming. Alternatively, a person may take a towel or disposable cleaning sheets such as a paper towel and get down on their knees and clean the localized area. This is also undesirable for many people since it requires them to stoop down and contact the floor with their hands. Some persons may find this uncomfortable or, due to physical limitations, impossible. Therefore, there is a need for improved devices and methods for simple cleaning duties such as removing localized areas of dirt and debris or lightly cleaning a surface. Previous attempts to address this need include small hand held rechargeable vacuum cleaners and improved self-wringing mops. However, these solutions do not adequately address the needs of typical homeowners. For example, if a homeowner has a small spill of liquid on a floor, they may not wish to use even the best of self-wringing mops since mops should be thoroughly rinsed after use to prevent contamination of the mop. The use of a paper towel may also be inadequate since it requires getting down on one's hands and knees to use.

Another example of a light cleaning job is where the homeowner wishes to remove a light coating of dust or debris from a window or mirror. Use of a bucket and sponge or rag is unnecessarily involved since what is really needed is a light cleaning of the surface. A homeowner may wish to just return the surface to its optimal appearance without unnecessary steps. Therefore, there is a need for a simple device to quickly and easily clean a variety of surfaces.

SUMMARY OF THE INVENTION

There is disclosed herein a cleaning tool for cleaning a surface. The tool includes a core which has a lower surface and an upper surface. Each surface has a side-to-side width and a back-to-front length. A set of cleaning sheets is removably supported on the lower surface in a stacked configuration. Each of the sheets includes a bibulous layer and a moisture barrier layer that prevents transport of liquid from the bibulous layer of one sheet to the bibulous layer of an adjacent sheet. Each of the sheets has an outward face for cleaning and an opposed inward face. Each of the sheets has a side-to-side width and a front-to-back length. The outward face of each of the sheets is designed to contact and clean a surface and thereby becomes soiled. Once the outer face of the outermost sheet becomes soiled, the sheet may be peeled away to expose a non-soiled sheet.

BRIEF DESCRIPTION OF THE DRAWINGS

FIG. 1 is a perspective view of one embodiment a mop according to the present invention;

FIG. 2 is an end view of the mop of FIG. 1;

FIG. 3 is a cross-sectional view a portion of one embodiment of a cleaning sheet for use with a mop according to the present invention;

FIG. 7 is a perspective view of a portion of a mop according to the present invention illustrating a preferred pivot range limiter;

FIG. 8 is a cross-sectional view of a portion of the mop of FIG. 7 taken along lines 8—8;

FIG. 9 is an exploded perspective view of a third embodiment of a mop according to the present invention;

FIG. 10 is an end view of the mop of FIG. 9;

FIG. 11 is a perspective view of a cleaning tool according to a fourth embodiment of the present invention wherein a core of the cleaning tool is sized to accept a hand;

FIG. 12 is a cross-sectional view of the cleaning tool of FIG. 11 taken along lines 12—12;

FIG. 13 is an additional perspective view of the cleaning tool of FIG. 11 showing perforations along an edge thereof;

FIG. 14 is an end view of the cleaning tool of FIGS. 11–13 showing the opening for insertion of a hand;

DETAILED DESCRIPTION OF THE PREFERRED EMBODIMENTS

Figure 4:
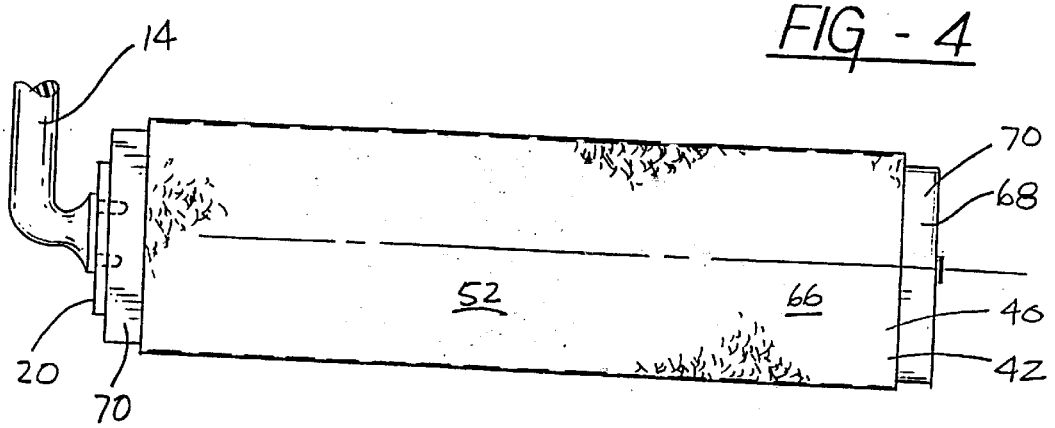
FIG. 4 is a bottom view of a second embodiment of a mop according to the present invention.

Referring to FIGS. 1 and 2, a mop according to the present invention is generally shown at 10. The mop 10 includes an elongated handle 12 for a user to grip the mop 10 and a mop head 20 which is interconnected with the mop handle 12 by a mop head mount 14. The elongated handle 12 is detachable from the mount 14. Other sizes and shapes of handles may be substituted, such as an extension pole to allow use of the mop to clean a surface that is hard to reach. The mop 10 can also be used without the elongated handle 12, with the user gripping the mop head mount 14 which acts as a short handle. The mop head 20 has a top side which is defined as an upper surface 22, and a bottom side which is defined as a lower surface 24. The upper and lower surfaces 22, 24 are interconnected at the front of the mop head 20 by a leading edge 26 and at the back of the mop head by a trailing edge 28. The sides of the mop head are defined by a pair of ends 30.

An elongated web 38 of cleaning material 40 is wrapped about the mop head 20 so as to form an oblate roll 42 with a plurality of layers 44. The roll 42 of material 40 defines a first plurality of cleaning sheets 46 supported on the lower surface 24 of the mop head 20 and a second plurality of cleaning sheets 48 supported on the upper surface 22 of the mop head 20. The cleaning sheets 46, 48 are each removably supported on the respective surfaces 22, 24 in stacked configurations. While in the preferred embodiment the cleaning sheets 46, 48 are defined by a web 38 of cleaning material 40 wrapped about the mop head 20, the cleaning sheets 46, 48 may also be individual sheets which are supported on one or both surfaces 22, 24 of the mop head 20 in a stacked configuration. For clarity of description, the roll 42 is defined as having an upper surface 50 on the top of the roll 42, a lower surface 52 on the bottom of the roll 42, a leading edge 54 interconnecting the upper 50 and lower 52 surfaces at the front of the roll 42, and a trailing edge 56 interconnecting the upper 50 and lower 52 surfaces at the rear of the roll 42. The upper 50 and lower 52 surfaces and the leading 54 and trailing 56 edges correspond to the like named portions of the mop head 20. The upper 50 and lower 52 surfaces of the roll 42 are preferably curved.

In the illustrated embodiment, the web 38 of material 40 includes perforations 58 to allow a portion of the web 38 of material 40 to be removed from the remainder of the web 38. Most preferably, the perforations 58 are located on the leading 54 and trailing 56 edges of the roll 42 so that a portion of the web 38 forming the upper 50 or lower 52 surface may be removed in its entirety, thereby exposing a fresh surface. The perforations 58 may either be cut after the roll 42 is formed or the material 40 may be perforated prior to forming the roll 42. By "perforations," it is meant that the web has areas designed to tear or separate. This includes the use of a weakened area, a series of small cuts, or one or more large slits.

The roll 42 of cleaning material 40 is preferably configured so as to allow the use of refills. Roll 42 is formed such that it may be removed from the mop head 20 and replaced with a new roll 42. The roll 42 may be formed with some type of core, such as a cardboard tube, or as a coreless roll. Either way, the roll 42 is configured to be placed over mop head 20. Once the roll 42 of cleaning material 40 is used up, a new roll 42 can be placed on the mop head 20.

The cleaning material 40 or individual cleaning sheets have an outward face 60 for cleaning and an opposed inward face 62. In using the mop 10 of the illustrated embodiment, the mop 10 is oriented such that the lower surface 52 of the mop head 20 faces a surface to be cleaned, such as a floor. The outward face 60 of the lower surface 52 of the roll 42 is brought in contact with the floor, thereby becoming soiled. When the used portion of the roll 42 becomes sufficiently soiled as to require replacement, that portion of the roll 42 is removed by peeling off the material 40 and tearing along a perforation 58. Thereby, an unsoiled portion of the material is exposed for cleaning. If using the embodiment with a plurality of individual sheets 46, 48 not in a roll 42, the outermost sheet may be peeled off once it becomes soiled.

The illustrated mop head 20 is an elongated piece of material such as plastic or metal. In plan view, the mop head 20 is generally rectangular with a side-to-side width (the distance between the ends 30) greater than its front-to-back length (the distance between the leading edge 26 and trailing edge 28). In one preferred embodiment, a mop head 20 has a side-to-side width of approximately 13 inches and a front-to-back length of approximately four inches, though other sizes and shapes are certainly possible.

Referring to FIG. 2, the mop head 20 is generally rectangular in cross-section with a thickness (the distance between the upper surface 22 and the lower surface 24) less than its front-to-back length. In one preferred embodiment, the mop head 20 has a thickness of approximately one inch. As shown, the upper 22 and lower 24 surfaces are preferably slightly convexly curved in cross-section, but alternatively may be flat or greatly curved.

The mop head 20 has an axial bore 32 which passes widthwise through the mop head 20, passing through both ends 30. The axial bore 32 defines a support axis 34 for the mop head 20. The mop head mount 14 is generally hook shaped and has a handle mounting portion 16 at one of its ends, and a perpendicular support portion 18 at its other end. The mounting portion 16 and support portion 18 are interconnected by an interconnection portion 17 that meets the support portion 18 at right angles and curves up to meet the mounting portion 16. The support portion 18 is disposed in the axial bore 32 of the mop head 20, thereby interconnecting the mop head 20 with the mop handle 12. As will be clear to one of skill in the art, a mop head mount 14 of this type is similar to the mounting arrangement used with paint rollers and the like and may be implemented in a number of ways. In an alternative embodiment, the elongated handle 12 is not used. Instead, the mounting portion 16 of the mount 14 acts as a handle and is gripped by a user.

Preferably, the mop head 20 is pivotally interconnected with the mop handle 12 by the mop head mount 14. In the illustrated embodiment, the support portion 18 of the mop head mount 14 is rotatable within the axial bore 32 of the mop head 20 thereby allowing the mop head 20 to pivot about the support axis 34 of the mop head. As illustrated, the lower surface 24 of the mop head 20 is positioned on the bottom side of the mop head 20 so as to face a horizontal surface to be cleaned, such as a floor. Because the mop head 20 and the mop handle 12 are pivotally interconnected, the mop head 20 can be rotated 180 degrees relative to the mop handle 12 thereby repositioning the lower surface 24 on the top side of the mop head 20 and the upper surface 22 on the bottom side of the mop head 20. By rotating the mop head 20, both the upper 22 and lower 24 surfaces of the roll 42 of material 40 can be used to clean and will become soiled.

As discussed above, the roll 42 of cleaning material 40 may be formed with some type of core. In an alternative embodiment, the mop head 20 comprises a pair of end supports which interconnects with the core of the roll 42 of cleaning material 40, thereby supporting the roll 42. In this case, the mop head does not extend through the center of the roll but instead supports the roll at its ends. This is similar to the way in which some types of paper towel holders support a roll of paper towels, by engaging the ends of a central core. This is a particularly simple embodiment of the present invention and is desirable for some applications. In this embodiment, the core of the roll 42 acts as part of the mop head 20 with the web 38 of cleaning material 40 wrapped thereabout.

Other alternative mop head designs also fall within the present invention. As discussed previously, a first plurality of cleaning sheets may be supported in a stacked configuration on only one surface of a mop head. This simpler embodiment of the mop head may be of a variety of shapes as long as it provides a surface for supporting a stack of cleaning sheets. Alternatively, a plurality of cleaning sheets may be stacked on more than one surface of the mop head. For example, with a rectangular cross section mop head, a first and a second plurality of cleaning sheets may be separately supported on the upper and lower surfaces of the mop head. This differs from the earlier discussed embodiment in that the first and second plurality of cleaning sheets are each individual stacks rather than being formed as part of a roll. As another example, the mop head may be triangular in cross section, having three surfaces, an upper surface, a lower surface, and a third surface. Individual stacks of cleaning sheets may be supported on one or more of these surfaces.

The web 38 of cleaning material 40 is wrapped about the mop head 20 so as to form an oblate roll 42. As used herein, "oblate roll" refers to a variety of shapes wherein the distance between the upper 22 and lower 24 surfaces of the roll 42 is less than the distance between the leading edge 54 and trailing edge 56 of the roll. The oblate roll 42 may be ellipsoidal, oval, or football-shaped in cross-section so as to present a curved upper 22 and lower 24 surface. Alternatively, the oblate roll 42 may also be a roll that has a flat upper 22 and lower surface 24. However, it is preferred that the upper 22 and lower 24 surfaces are curved. The oblate shape of the roll 42 is important to the function of the mop 10. Because the roll 42 is not round, the oblate roll 42 resists rolling across a surface to be cleaned as the contact is moved across the surface. Instead, the lower surface 24 of the roll 42 tends to remain in contact with the surface to be cleaned as the mop head 20 is moved across the surface. The mop head 20 will rotate slightly as it is moved back and forth across the surface to be cleaned but resists clipping to expose the upper surface 22 due to the flattened shape of the oblate roll 42.

The web 38 of cleaning material 40 which forms the oblate roll 42 may be of several types depending upon the application of the mop 10. In FIGS. 1 and 2, the cleaning material 40 disposed on the mop head 20 is a single layer of bibulous material such as a non-woven material or a paper towel-like material. Sponge-like and woven materials are also possible. By "bibulous" it is meant that the cleaning material 40 is absorbent and is capable of being imbibed with a cleaning solution. In the simplest embodiment, the cleaning material 40 is a paper towel-like material which can be used to absorb small spills. The material 40 can also be sprayed with a cleaning solution and then brought into contact with a soiled region for cleaning the soiled region. Alternatively, the cleaning material 40 is a non-woven material that is pretreated with a substance such as mineral oil or lemon oil. The cleaning material 40 may also be pretreated with other substances such as a disinfectant. The oil treated embodiment is especially useful for picking up dust such as from a hardwood floor. The mineral oil or lemon oil allows the mop 10 to pick up and retain dust as it comes into contact with the cleaning material 40. This provides an especially easy and quick way to make a hardwood floor appear freshly cleaned. The cleaning material 40 may be embossed to give the outward surface texture so as to improve the cleaning ability of the cleaning material 40.

The layers 44 of the cleaning material 40 forming the oblate roll 42 may be retained in their stacked configuration in a variety of ways. Many non-woven and paper towel-like materials actually cling to themselves and therefore the outermost layer would tend to stay in place on the roll 42 until manually removed by the user. Alternatively, and preferably, the inward face 62 of each of the layers 44 of cleaning material 40 is treated with an adhesive 64 for retaining the layers 44 in place. This causes the inward face 62 of one layer 44 to stick to the outward face 60 of an adjacent layer 44. As will be clear to one of skill in the art, the adhesive 64 is chosen and applied so as to allow easy releasability of a soiled portion of the cleaning material 40 from the remainder of the roll 42. Adhesive may be applied to the inward face 62 of the cleaning material 40 in a pattern or the adhesive 64 may be flood coated on the inward face 62 of the cleaning material 40. Alternatively, only a portion of the inward face 62 may be adhesive coated. For example, it may be desirable to leave one or more of the edges of the material 40 uncoated to make removal easier.

Referring now to FIG. 3, a portion of a preferred embodiment of the cleaning material 40 is shown in cross section. In this embodiment, the cleaning material 40 includes a bibulous layer 66, such as a non-woven or paper towel-like material, that defines the outward face 60 of the cleaning material 40. The bibulous layer 66 may also be a thin sponge-like material or a woven material. The cleaning material 40 also has a moisture barrier layer 68 that is operative to prevent transport of liquid from the bibulous layer 66 of one sheet 46, 48 to the bibulous layer 66 of an adjacent sheet 46, 48 when the sheets are in a stacked configuration. Preferably, the moisture barrier layer 68 also supports and strengthens the bibulous layer 66. The moisture barrier layer 68 defines the inward face 62 of the cleaning material 40 and is preferably pattern coated with adhesive 64 for retaining one layer 44 of cleaning material 40 in place on an adjacent layer 44 of cleaning material 40. The moisture barrier layer 68 may be any of a variety of thin plastic materials or may be formed of other material which prevents the transport of moisture therethrough. The moisture barrier layer 68 may also be formed by coating the bibulous layer 66 with a moisture barrier substance. Adhesive 64 may be either pattern coated or flood coated on the inward face 62 of the moisture barrier layer 68. Alternatively, where the moisture barrier layer 68 is a coating on the bibulous layer 66, the moisture barrier layer 68 may be naturally tacky, thereby eliminating the need for additional adhesive 64. As another alternative, the cleaning material 40 may be a single layer material with inherent moisture barrier or moisture resistant characteristics.

The use of a multiple layer cleaning material 40, as shown in FIG. 3, allows for a variety of combinations of materials and treatments to suit a variety of applications. For the simplest arrangement, the bibulous layer 66 is simply an absorbent sheet which can be used for light cleaning duties such as soaking up spills. The moisture barrier layer 66 prevents the spill from wetting more than the outermost layer of the cleaning material 40. Once the bibulous layer 66 is soiled, or has absorbed its capacity of liquid, the user may peel the outermost layer of the cleaning material 40 from the remainder of the roll 42 thereby exposing a new bibulous layer 66. The mop head 20 may also be rotated to expose the upper surface 50 of the roll 42 for further cleaning. Alternatively, the bibulous layer 66 may be pretreated with a liquid such as dusting oils or cleaning solutions. Because the bibulous layer 66 is sandwiched between adjacent moisture barrier layers 68, the dusting oil or cleaning solution is prevented from evaporating from all but the outermost layer of the roll. Therefore, when a user is ready to use the mop, the user first peels off the outermost layer to expose a fresh bibulous layer 66 that is pretreated with a dusting oil or cleaning solution. Alternatively, the mop 10 is provided with a cover configured to cover and moisture seal the mop head 20 when it is not in use. The cover prevents evaporation from the outermost layer of the roll 42 so that the mop 10 remains ready to use.

Referring now to FIG. 4, a second embodiment of a mop 10 according to the present invention is shown. This embodiment differs from the embodiment of FIG. 1 in that the cleaning material 40 consists of two layers, a bibulous layer 66 and a moisture barrier layer 68, as in FIG. 3. As shown, the moisture barrier layer 68 is wider than the bibulous layer 66 leaving a projecting portion 70 which projects beyond each side of the bibulous layer 66 adjacent the ends 30 of the mop head 20. These projecting portions 70 serve a couple of purposes. First, the projecting portions 70 do not become soiled during the cleaning process because they are not absorbent or treated with cleaning solution. Therefore, the projecting portions 70 provide a non-soiled area which a user can grip to help remove the outermost layer from a roll 42 of cleaning material 40. Secondly, the inward face 62 of the moisture barrier layer 68 is treated with an adhesive causing the projecting portions 70 to stick to the adjacent projecting portions 70 in the adjacent layers 44 of the roll 42. This further seals in the unsoiled bibulous layers 66 to prevent their premature contamination. The projecting portions 70 prevent liquid and dirt from contaminating the ends of the unexposed bibulous layers 66 by sealing off those ends. Preferably, this allows the roll 42 of cleaning material 40 to be held under a faucet or dipped in a bucket thereby wetting the outermost bibulous layer 66 without wetting the unexposed layers. Alternatively, the moisture barrier layer 68 does not project beyond the bibulous layer 66 or projects only at one side.

Figure 5:
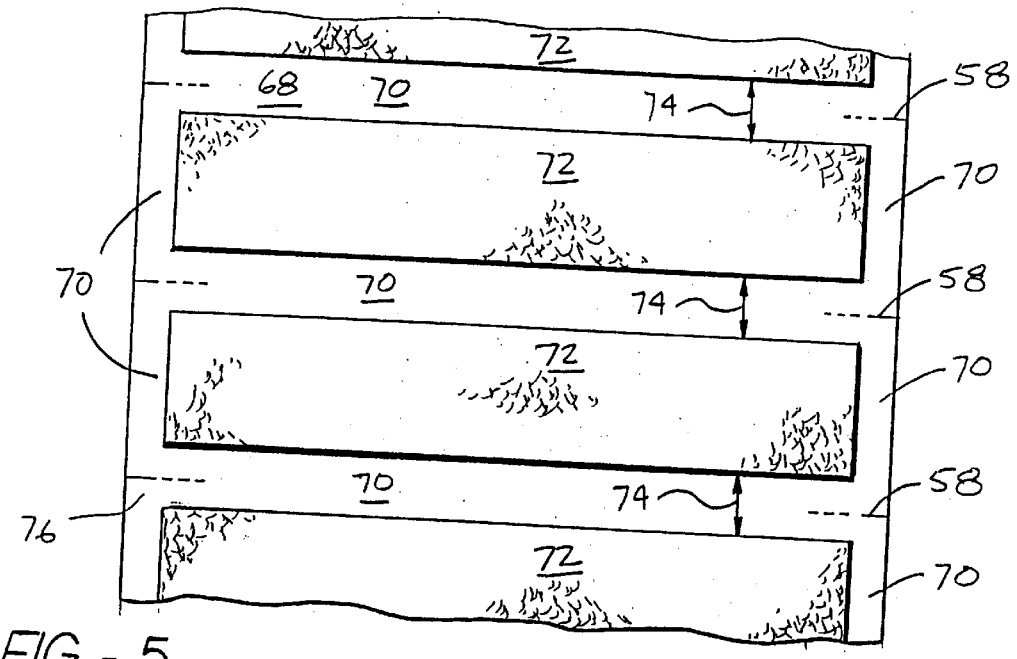
FIG. 5 is a plan view of a portion of one embodiment of a web of cleaning material for use with a mop according to the present invention.
Figure 6:
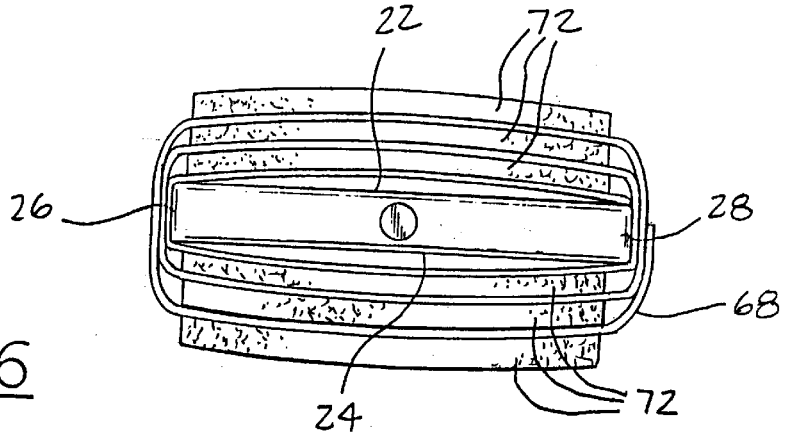
FIG. 6 is an end view of a mop head with a web of cleaning material as shown in FIG. 5 wrapped about the mop head.

Referring now to FIGS. 5 and 6, another alternative embodiment of the cleaning material 40 is shown. In this embodiment, the web 38 of cleaning material 40 includes a web 38 of moisture barrier material 68 that acts as both a support layer and a moisture barrier layer. A plurality of bibulous cleaning pads 72 are supported on the support layer along its length leaving a gap 74 between each cleaning pad 72. Therefore, the support layer forms a continuous web 38 with the bibulous pads 72 placed at intervals along the support layer. As shown in FIG. 6, the web 38 of cleaning materials 40 is then wrapped about the mop head 20 so as to position the bibulous pads 72 on the upper 22 and lower 24 surfaces of the mop head 20. The gaps 74 between the pads 72 are positioned adjacent the leading 26 trailing 28 edges of the mop head 20. As will be clear to one of skill in the art, the gaps 74 between the bibulous pads 72 preferably vary in dimension so as to allow the bibulous pads 72 to remain in a stacked configuration when the web 38 of cleaning material 40 is wrapped about the mop head 20. The outer layers of the oblate roll 42 must have larger gaps 74 or larger bibulous pads 72 so that the bibulous pads 72 continue to be aligned as the roll 42 is formed. Preferably, the support layer is perforated in each of the gaps 74 so as to allow removal of a portion of the support layer including one bibulous pad 72 from the roll 42 of cleaning material 40.

As can be seen, this configuration of the cleaning material 40 creates a projecting portion 70 that extends around the entire perimeter of each bibulous pad 72, thereby forming a perimeter margin 76. Therefore, the support/moisture barrier layer 68 extends not only beyond each bibulous pad 72 adjacent the ends 30 of the mop head 20, but also beyond each bibulous pad 72 adjacent the leading 26 and trailing 28 edges of the mop head 20. By adhesive coating the inward face 62 of the support/moisture barrier layer 68, each perimeter margin 76 can be bonded to an adjacent perimeter margin 76 thereby totally encapsulating each unexposed bibulous pad 72. Preferably, this allows the mop head 20, including the roll 42 of cleaning material 40, to be submerged in a bucket of cleaning solution, with only the outermost bibulous pads 72 being exposed to the cleaning solution. Like the configuration in FIG. 4, the configuration of FIG. 6 provides clean portions of the cleaning material 40 for a user to grip when removing an outermost soiled layer. The configuration in FIG. 6 is especially advantageous in that a portion of the cleaning material 40 adjacent each perforation 58 does not become soiled in the cleaning process, making removal a more pleasant task.

In another embodiment, some or all of the outward face 60 of the perimeter margins 76 may be coated with a light adhesive so that dirt and debris tends to stick to the perimeter margin 76. This allows the perimeter margin to pick up dirt and debris which is pushed ahead of or pulled behind the bibulous pad 72 during the cleaning process thereby retaining the dirt or debris.

In alternative embodiments, the bibulous pads 72 may be positioned and/or sized such that they are flush with one or both sides of the moisture barrier layer 68, thereby eliminating all or part of the projecting portion 70. Also, a gap 74 is not required between each pad 72. Two pads 72 may be flush to one another followed with a gap 74 and then two more flush pads 72. Or, all pads 72 may be flush with no gaps 74. In these configurations, perforations may be placed after each pad 72, only in the gaps 74, or only between flush pads 72.

The bibulous pads 72 or the bibulous layers 66 of the above-discussed embodiments may be pretreated with a variety of substances. This includes dusting oils and cleaning solutions. As one example, pads 72 or the layer 66 may be pretreated with a dry antibacterial substance which becomes activated when the pad 72 or layer 66 is wetted. All pads 72 or the entire bibulous layer 66 may be treated with one substance such as the dusting oil or cleaning solution. Alternatively, different portions of the bibulous layer 66 or different bibulous pads 72 may be treated with different substances. As one alternative, the embodiment of the mop 10 having bibulous pads 72 separated by gaps 74 may have pads 72 treated with one substance alternate with pads 72 treated with a second substance. The first substance may be a solvent while the second substance may be a neutralizer. The pads located on the upper surface point to the mop head 20 would be treated with the first substance while the pads 72 located on the lower surface 24 of the mop head 20 would be treated with the second substance. Therefore, the user would first use the pads 72 located on one of the surfaces to apply the first substance, and then would rotate the mop head 20 180 degrees to use the pads 72 located on the other surface. As another example, the pads 72 located on the lower surface of the mop head 20 may be treated with a cleaning solution while the pads 72 located on the upper surface 22 of the mop head is not pretreated and therefore merely absorbent. The user would use the pads 72 located on the lower surface 24 to apply cleaning solution to the surface to be cleaned and would then rotate the mop head 20 and use the pad 72 located on the upper surface 24 to absorb the cleaning solution from the surface to be cleaned. Many other variations on this approach fall within the present invention.

As shown in FIG. 6, each of the bibulous pads 72 is disposed only on either the upper 22 or lower 24 surface of the mop head 20 and does not extend onto the leading 26 or trailing 28 edges. However, in an alternative preferred embodiment, the bibulous pads 72 extend across the entire upper 22 or lower 24 surface and wrap up onto both the leading 26 and trailing 28 edge of the mop head 20 thereby leaving only a small gap 74 between each bibulous pad 72. This embodiment increases the usable amount of cleaning material 40 and also takes advantage of the natural curvature of the outer surface of the roll 42. As the mop head 20 is moved back and forth across the cleaning surface, the portion of the cleaning pad 72 in contact with the cleaning surface will be changed as the mop head 20 pivots slightly front to back. As the cleaning pad 72 pivots front to back, different portions of the curved surface come into and out of contact with the cleaning surface. Portions of the cleaning pad 72 adjacent the leading 26 and trailing 28 edges thereby are able to lift dirt and debris out of contact with the floor as the cleaning direction is reversed.

Referring now to FIGS. 7 and 8, a portion of an alternative preferred embodiment of mop head 80 is shown. In this embodiment, the mop head 80 is formed with a pair of end caps 82 interconnected by a series of metal rods 84 similar to the construction of a paint roller head. However, unlike a paint roller head, the mop head 80 of the present invention is not circular in cross section but rather is somewhat flattened. The end caps 82 interconnect with the mop head mount 14. Each end cap 82 has a hole 86 therethrough defining the support axis 88 of the mop head 80. The mop head mount 14 disposed in the holes 86 thereby pivotally supporting the mop head 80. During the cleaning process, is desirable that the mop head 80 not be able to rotate beyond a certain range. The preferred range may vary but it is desirable that the mop head 80 not be allowed to rotate such that the upper 83 and lower 85 surfaces trade positions. To rotate the mop head 180 degrees to expose the other surface, the user will first need to manually rotate the mop head 80. As will be clear to one of skill in the art, selectively limiting the range of pivotal motion may be accomplished in many ways. One approach is shown in FIGS. 7 and 8. A first travel limiter 90 and a second travel limiter 92 are disposed on one end cap 82 and extend therefrom. These travel limiters 90, 92 engage the mop head mount 14 as it pivots and approaches their position. The limiters 90, 92 may be as simple as plastic tabs extending outwardly from the end caps 82. In this case, when the user is ready to rotate the mop head 180 degrees, the user merely flexes the mop head mount 14 sufficiently to clear one of the limiters 90, 92 and rotates the mop head mount 14 past the stop. At times, it may be desirable to lock the mop head mount 14 at one position relative to the mop head 80 so that the mop head 80 is not allowed to rotate relative to the mop handle 12. This may also be accomplished in a number of ways. In the embodiment shown in FIGS. 7 and 8, the first travel limiter 90 includes a recess 94 in its outward extending face 96. The mop head mount 14 may be flexed so as to pass partially over the limiter 90 and then released so as to engage the recess 94 in the outward extending face 96 of the limiter 90. The mop may then be used to clean a cleaning a surface such as a wall.

The pivotal interconnection between the mop head 80 and the handle may be designed to include a predetermined amount of friction thereby preventing easy rotation of the mop head 80. Friction in the pivotal interconnection will help to prevent bouncing, jumping, or vibrating of the mop head 80 as it is wiped across a surface. Alternatively, the amount of friction may be adjustable.

Referring now to FIGS. 9 and 10, a third embodiment of a mop 100 according to the present invention is shown. This embodiment differs from the earlier embodiments mainly in the cross sectional shape of the mop head 102. In this embodiment, the mop head 102 has a triangular cross section. The triangle has two long sides and one shorter side. The long sides define an upper surface 104 and a lower surface 106 of the mop head 102 and the shorter side defines a back surface 108. The sides are interconnected by radiused corners. The radiused comer which joins the upper 104 and lower 106 surfaces defines the leading edge 110 of the mop head 102 and the back surface 108 defines the trailing edge. As discussed earlier, the mop head 102 is formed similar to a paint roller having a pair of end caps 112 interconnected by a plurality of metal rods 114. A roll of cleaning material is wrapped about the metal rods 114. A spring 116 is positioned around the support portion 18 of the mop head mount 14 and is designed to bias the mop head 102 to a predetermined neutral position relative to the mop handle. The spring 116 wraps around the support portion 18 of the mop head mount 14 and is positioned between one of the end caps 112 of the mop head 102 and the interconnecting portion 17 of the mop head mount 14. One end of the spring 116 is a tab 118 which engages a hole 120 in the end cap 112. The other end of the spring 116 includes a clip 122 for clipping onto the interconnecting portion 17 of the mop head mount 14. When the spring 116 is in its unstressed position, the mop head 102 is in the neutral position relative to the mop handle. This neutral position is indicated as A in FIG. 10. As the mop head mount 14 is rotated in either direction away from the neutral position, the spring begins to resist the movement. However, the spring rate is chosen so as to allow the mop handle to move in either direction sufficiently to allow use of the mop head 102 on a cleaning surface. For example, in FIG. 10 the position marked as B is the position in which the mop head mount 14 would be located when a user wishes to use the lower surface 106 of the mop head 102 to clean a horizontal surface. In this position, the spring 116 creates only minor resistance to further rotation of the handle thereby allowing easy use of the mop 100. However, if the user attempts to rotate the handle substantially beyond the position marked as B, the spring 116 will resist the movement sufficiently to prevent the mop head 102 from moving to an unusable position. When the user wishes to use the upper surface 104 of the mop 100 to clean a horizontal surface, the user merely flips the handle over thereby bringing the upper surface 104 close to the horizontal surface to be cleaned. The mop head mount 14 can then be flexed to the position marked as C so that the handle is in a comfortable position during use of the mop 100. The configuration shown in FIGS. 9 and 10 allows for easy use of either the upper 104 or lower 106 surface without the necessity of forcing the mop head mount 14 past a pivot stop.

The cleaning material configured for use with a mop 10 according to the present invention has utility beyond the illustrated mops 10. For example, cleaning material 40 as illustrated in FIG. 3 can be torn from a roll 42 of such material 40 and used by hand to clean up a spill or other mess. A user may keep a refill roll handy for this purpose. Such material 40 can be especially useful when cleaning up objectionable messes that the user does not wish to contact with their hand. The moisture barrier layer 66 prevents waste contacting the bibulous layer 66 from being transported through to the user's hand. In addition, the adhesive 64 disposed on the moisture barrier layer 68 can be used to stick the cleaning material 40 to a user's hand for small cleanup jobs. A piece of material 40 can be stuck to the user's hand and formed around fingers and thumb and used to clean objects such as individual slats of vertical blinds and fan blades on ceiling fans. The user merely needs to wipe the object to be cleaned instead of wiping it with their bare hand. There is no need to grip the cleaning sheet; instead, the cleaning sheet hangs onto the user's hand.

The adhesive can also advantageously be used to stick portions of a cleaning sheet to itself. For example, if a person picks up an objectionable piece of waste with the bibulous layer of the cleaning material, the person can then crumple the piece of cleaning material around the piece of objectionable waste causing the adhesive on portions of the moisture barrier layer to contact other portions of the cleaning material causing the entire crumpled sheet to remain crumpled. This is similar to the effect created when crumpling up a piece of adhesive tape; a compact and secure ball can be formed. The adhesive side of the sheet can also be used to pick up crumbs, pet hair, and other debris. Like considerations apply with cleaning material that does not include the moisture barrier layer. The individual cleaning sheets or portions of the roll of cleaning material can be used to clean objects and surfaces without the use of a mop.

The above discussion has focused primarily on the cleaning of surfaces such as floors. However, the present invention has utility in cleaning many types of surfaces, including but not limited to walls, windows, mirrors, tables, ceilings, and furniture. Therefore, it should be understood that the word "floors" should be broadly construed to include other surfaces to be cleaned.

Referring now to FIGS. 11–15, a cleaning tool 200 according to a fourth embodiment of the present invention is illustrated in several views. This embodiment is more specifically directed towards the cleaning of surfaces other than floors. Specifically, the cleaning tool is designed to be used by hand rather than by using an elongated handle, as with the earlier embodiments of the mop. This cleaning tool 200 is well suited to cleaning countertops, mirrors, walls, as well as the coat of a pet or the skin of a person. In this embodiment, a central core 202 takes the place of the mop head in the prior embodiments. That is, the core 202 defines the center of the cleaning tool 200. The core 202 may be made from many materials including paper, plastic or plastic film, or a variety of fabrics. The core 202 has an upper surface 204 and lower surface 206, as best shown in FIG. 14. A plurality of cleaning sheets 208 is supported on the lower surface 206 in a stacked configuration. Preferably, a second plurality of cleaning sheets 208 is supported on the upper surface 204 also in a stacked configuration.

As best shown in FIG. 11, the cleaning tool 200 is preferably designed so as to accommodate a human hand 210. Specifically, the core 202 has an opening 212 at one end and is closed at its other end 214. The core 202 is preferably tapered from the open end 212 down to the closed end 214. The hand 210 may be slid into the opening 212 so that the hand 210 is positioned inside the core 202. Then, the core may be positioned such that the lower surface is directed towards a surface to be cleaned, thereby bringing the outermost cleaning sheet 208 into contact with the surface to be cleaned. The surface may then be wiped to clean the surface thereby causing the outermost sheet 208 to become soiled. As with the prior embodiments, the soiled outermost sheet may be removed from the remaining stack to expose a new unsoiled sheet.

In plan view, the cleaning tool is generally rectangular with an end-to-end width (the distance between the ends 212 and 214) greater than its front-to-back length (the distance between the leading edge and trailing edge). In one preferred embodiment, the tool has an end-to-end width of approximately 9 inches and a front-to-back length of approximately 7 inches, though other sizes and shapes are certainly possible.

The mitt is generally rectangular in cross-section with a thickness (the distance between the upper surface and the lower surface) less than its front-to-back length. In one preferred embodiment, the mitt has a thickness of approximately one inch. As shown, the upper and lower surfaces are preferably slightly convexly curved in cross-section, but alternatively may be flat or greatly curved. Like the mop embodiment, some embodiments of the cleaning tool may be considered an oblate roll.

Figure 15:
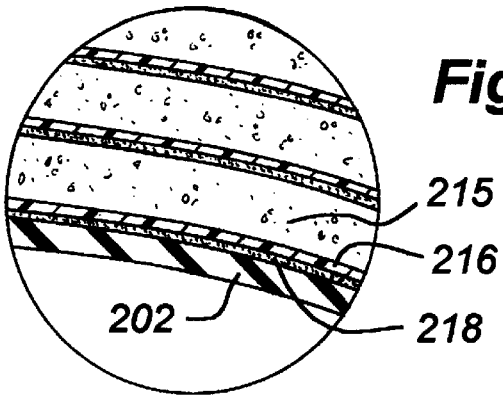
FIG. 15 is a detailed blow up view of a portion of the cleaning tool of FIG. 14, the magnified portion being indicated by circle 15 in FIG. 14.

The cleaning tool of the fourth embodiment may be constructed in any of the ways discussed as with the mop. That is, a single stack of cleaning sheets may be positioned on only one face of the core. More preferably, a continuous roll of cleaning sheets may be wrapped about the core so as to define a stack of cleaning sheets on both the top and bottom. This is illustrated in FIGS. 11–13. Also, as shown in FIG. 15, the cleaning sheets preferably each consist of a bibulous layer 215 which overlies a moisture barrier layer 216. The moisture barrier layer 216 may be coated with an adhesive 218 to adhere the adjoining layers to one another. As with the prior embodiments, the cleaning sheets may be constructed in other ways. As shown in FIGS. 11 and 12, the moisture barrier layers 216 may extend beyond the edges of the bibulous layer 215 so as to define a perimeter. The perimeters of the various layers may be adhered to one another by a releasable adhesive so as to seal each bibulous layer between adjacent moisture barrier layers. This would allow the cleaning tool or mitt 200 to be dipped into water causing only the outermost bibulous layer to be wetted. Also, the perimeter may have an adhesive coating to allow it to pick up debris. As shown in FIG. 14, the moisture barrier layers 216 may extend only to the edges of the bibulous layers 215 and not extend into the perimeter area. As a further alternative, the innermost moisture barrier layer 216 may form the core 202, as illustrated in FIG. 12. Also, the core 202 may be rigid or flexible.

Figure 16:
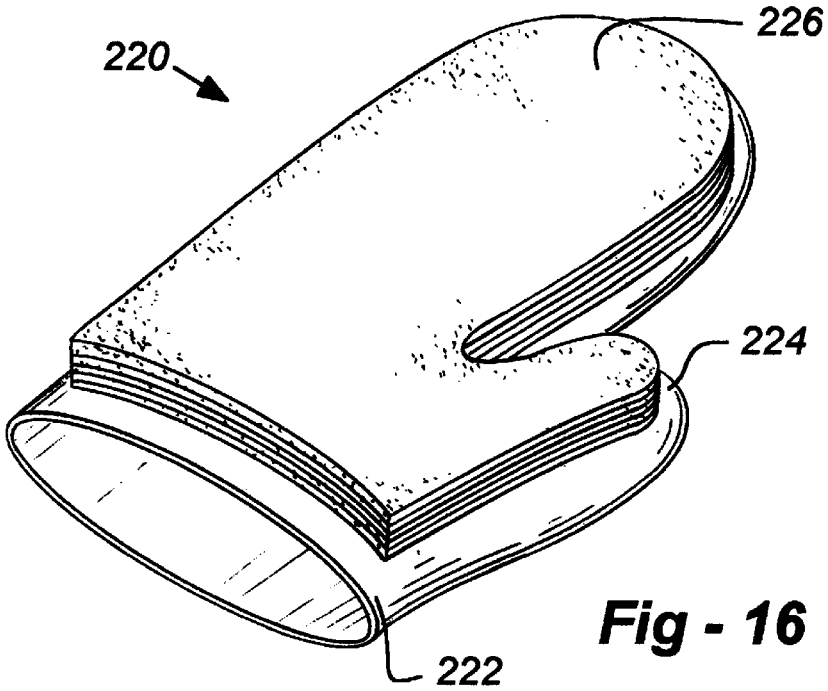
FIG. 16 is a perspective view of a cleaning tool according to a fifth embodiment of the present invention wherein the core of the cleaning tool is mitt shaped.
Figure 17:
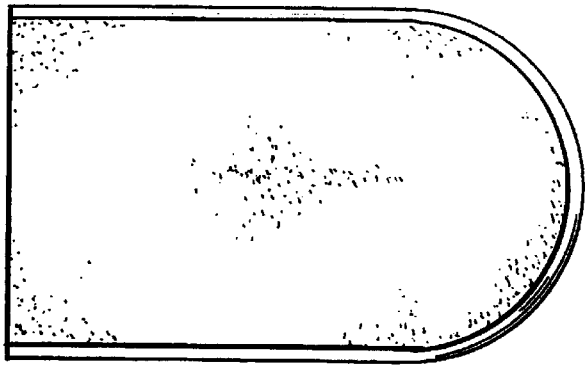
FIG. 17 is a top plan view of a cleaning tool according to a sixth embodiment of the present invention.

Referring now to FIG. 16, a fifth embodiment of the present invention is illustrated in the form of a mitt 220. This embodiment has a mitt shaped core 222, which is preferably flexible. As shown, the core 222 is mitt shaped or hand shaped including a thumb portion 224. In this embodiment, a plurality of cleaning sheets 226, which are also mitt shaped, are stacked on one surface of the mitt shaped core 222. FIG. 17 shows a sixth embodiment of the present invention which may also be considered mitt shaped, though without a thumb portion.

In each of the embodiments of the cleaning tool, each cleaning sheet may include both a moisture barrier layer and bibulous layer, or may exclude the moisture barrier layer. Also, independent of whether the cleaning sheets include a moisture barrier layer, the bibulous layer may be pretreated with a variety of substances. For example, the bibulous layer may be pretreated with a cleaning solution such as window cleaner or a soap product. It may also be pretreated with a scent compound, a wax, a dusting oil, a shine enhancer, an antibacterial material, hair cleaner, hair conditioner, as well as medical substances. Certain versions of the present invention may be specifically constructed for use on pets. In this case, the bibulous layer may be pretreated with a substance designed to clean the coat of a pet. Alternatively, or in addition, the layer may be coated with a conditioning agent for the pet's coat. As mentioned previously, medical substances may be included. For example, a skin treatment substance may be embedded in the bibulous layer for application to the skin of a human or pet. Scent compounds applied to the bibulous layer may allow transfer of a scent to the coat of an animal. All or part of the outwardly facing surface of the cleaning sheets may be coated with an adhesive to facilitate collection and retention of debris. For example, the outer surface may be pattern coated with an adhesive so that the cleaning tool effectively picks up and retains pet hair and dander. A combination of various substances as well as adhesives may be applied to certain embodiments.

The bibulous pads or the bibulous layers of the above discussed embodiments may be pretreated with a variety of substances. This includes dusting oils and cleaning solutions. As one example, pads or the layer may be pretreated with a dry anti-bacterial substance, which becomes activated with the pad, or layer is wetted. All pads or the entire bibulous layer may be treated with one substance such as the dusting oil or cleaning solution. Alternatively, different portions of the bibulous layer or different bibulous pads may be treated with different substances. As one alternative, the embodiment of the tool having bibulous pads separated by gaps may have pads treated with one substance alternate with pads treated with a second substance. The first substance may be a solvent while the second substance may be a neutralizer. The pads located on the upper surface point to the mitt would be treated with the first substance while the pads located on the lower surface of the mitt would be treated with the second substance. Therefore, the user would first use the pads located on one of the surfaces to apply the first substance, and then would rotate the tool 180 degrees to use the pads located on the other surface. As another example, the pads located on the lower surface of the mitt may be treated with a cleaning solution while the pads located on the upper surface of the mitt is not pretreated and therefore merely absorbent. The user would use the pads located on the lower surface to apply cleaning solution to the surface to be cleaned and would then rotate the mitt and use the pad located on the upper surface to absorb the cleaning solution from the surface to be cleaned. Many other variations on this approach fall within the present invention. A cover may be provided to protect the tool and retain the pretreated materials.

In the embodiment shown in FIGS. 11 and 13, the web of material includes perforations 209 to allow a portion of the web of material to be removed from the remainder of the web. Most preferably, the perforations are located on the leading and trailing edges of the roll so that a portion of the web forming the upper or lower surface may be removed in its entirety, thereby exposing a fresh surface. The perforations may either be cut after the roll is formed or the material may be perforated prior to forming the roll. By "perforations," it is meant that the web has areas designed to tear or separate. This includes the use of a weakened area, a series of small cuts, or one or more large slits. Optionally, a slit across the web may also be employed. Also, the perforations may only be provided on one edge, rather than both the leading and trailing edges.

The cleaning tool may be configured so as to allow the use of refills. The roll or stack of cleaning sheets can be formed such that they may be removed from a rigid or flexible core and replaced with a new stack or roll. The roll may be formed with some type of core, such as a cardboard tube, or as a coreless roll. Either way, the roll is optionally configured to be placed over the core. Once the roll of cleaning material is used up, a new roll can be placed on the core.

Other variations on the cleaning tool are also possible. Any of the configurations discussed with respect to the mop may be applied to the tool.

In view of the teaching presented herein, other modifications and variations of the present inventions will be readily apparent to those of skill in the art. The foregoing drawings, discussion, and description are illustrated of some embodiments of the present invention, but are not meant to be limitations on the practice thereof. It is the following claims, including all equivalents, which define the scope of the invention.

I claim:

1. A cleaning tool for cleaning a surface, said tool comprising:

a core having a lower surface and an upper surface, each surface having a side-to-side width and a back-to-front length associated therewith;

a first plurality of cleaning sheets each removably supported on said lower surface in a stacked configuration, each of said sheets comprising a bibulous layer and a moisture barrier layer operative to prevent transport of liquid from said bibulous layer of one sheet to said bibulous layer of an adjacent sheet, each of said sheets having an outward face for cleaning and an opposed inward face, each of said sheets having a side-to-side width and a front-to-back length associated therewith, said outward face of each of said sheets configured for contacting and cleaning a surface and thereby becoming soiled, whereby when said outward face of the outermost sheet becomes soiled said sheet may be peeled away to expose a non-soiled sheet.

2. The cleaning tool according to claim 1, wherein said plurality of cleaning sheets are each maintained in said stacked configuration by a releasable adhesive.

3. The cleaning tool according to claim 1, wherein said tool comprises a mitt and said core is a mitt-shaped core with an opening defined at one end to allow insertion of a hand.

4. The cleaning tool according to claim 3, wherein said mitt-shaped core comprises two plastic members each having a generally hand-shaped perimeter, said plastic members being joined at said perimeters to form said mitt-shaped core.

5. The cleaning tool according to claim 3, wherein said outward face is pattern coated with adhesive.

6. The cleaning tool according to claim 3, wherein said outward face of at least some of said sheets is pattern coated with a scent compound.

7. The cleaning tool according to claim 3, wherein said mitt-shaped core includes a thumb portion.

8. The cleaning tool according to claim 3, wherein said mitt-shaped core does not include a thumb portion.

9. The cleaning tool according to claim 1, wherein said core is a tapered core with a wide end and a narrow end, an opening being defined in said wide end to allow insertion of a hand.

10. The cleaning tool according to claim 1, wherein each of said cleaning sheets has a length greater than the length of said lower surface of said core so as to define an extension portion, said extension portion wrapping up onto said core.

11. The cleaning tool according to claim 1, wherein said moisture barrier layer of each of said cleaning sheets defines said inward face of said cleaning sheet, and said bibulous layer of each of said cleaning sheets defines said outward face of said cleaning sheet.

12. The cleaning tool according to claim 1, wherein said moisture barrier layer of each of said cleaning sheets is larger than said bibulous layer so that a portion of said moisture barrier layer projects beyond said bibulous layer defining a projecting portion.

13. The cleaning tool according to claim 12, wherein said projecting portion project beyond all edges of said bibulous layer so as to form a perimeter margin around said bibulous layer.

14. The cleaning tool according to claim 13, wherein said perimeter margin of said cleaning sheets is bonded to said perimeter margin of an adjacent sheet so as to seal each of said unexposed bibulous layers between two moisture barrier layers.

15. The cleaning tool according to claim 14, wherein a releasable adhesive bonds said perimeter margins of each of said cleaning sheets to said perimeter margin of an adjacent sheet.

16. The cleaning tool according to claim 1, further comprising a second plurality of cleaning sheets each removably supported on said upper surface in a stacked configuration, each of said sheets comprising a bibulous layer and a moisture barrier layer operative to prevent transport of liquid from said bibulous layer of one sheet to said bibulous layer of an adjacent sheet.

17. The cleaning tool according to claim 1, wherein some of said bibulous layers are pretreated with a treatment substance selected from the group consisting of cleaning solution, scent, wax, dusting oil, shine enhancer, antibacterial material, hair cleaner, hair conditioner, and medical substances.

18. The cleaning tool according to claim 1, wherein at least a portion of said outward face of some of said sheets is coated with an adhesive to facilitate collection and retention of debris.

19. A cleaning tool for cleaning a surface, said tool comprising:

a core having a lower surface and an upper surface, each surface having a side-to-side width and a back-to-front length associated therewith;

a web of cleaning material wrapped about said core so as to form a roll defining a first plurality of cleaning sheets each removably supported on said lower surface in a stacked configuration, each of said sheets having an outward face for cleaning and an opposed inward face, each of said sheets having a side-to-side width and a front-to-back length associated therewith, said outward face of each of said sheets configured for contacting and cleaning the surface and thereby becoming soiled, whereby when said outward face of the outermost sheet becomes soiled said sheet may be peeled away to expose a non-soiled sheet, said roll of cleaning material further defining a second plurality of cleaning sheets supported on said upper surface of said core, said web of cleaning material comprising a bibulous layer and a moisture barrier layer operative to prevent transport of liquid from said bibulous layer of one sheet to said bibulous layer of an adjacent sheet.

20. The cleaning tool according to claim 19, wherein said web is perforated side to side at intervals so that a portion of said web may be removed so as to expose a clean portion of said web.

21. The cleaning tool according to claim 19, wherein said moisture barrier layer comprises an elongated support layer and said bibulous layer comprises a plurality of cleaning pads supported on said support layer along the length of said support layer so as to leave a gap between each cleaning pad and the adjacent cleaning pads, said support layer further having perforations defined therein, said perforations positioned in each of said gaps so as to allow a portion of said web to be removed from the remainder of said web.

22. The cleaning tool according to claim 19, wherein said core is a tapered core with a wide end and a narrow end, an opening being defined in said wide end to allow insertion of a hand.

* * * * *